US007470357B1

(12) United States Patent
Hoehn et al.

(10) Patent No.: US 7,470,357 B1
(45) Date of Patent: Dec. 30, 2008

(54) HYDROCARBON CONVERSION PROCESS

(75) Inventors: Richard K. Hoehn, Mount Prospect, IL (US); Vedula K. Murty, Willowbrook, IL (US)

(73) Assignee: UOP LLC, Des Plaines, IL (US)

( * ) Notice: Subject to any disclaimer, the term of this patent is extended or adjusted under 35 U.S.C. 154(b) by 318 days.

(21) Appl. No.: 11/299,062

(22) Filed: Dec. 8, 2005

(51) Int. Cl.
*C10G 65/12* (2006.01)

(52) U.S. Cl. ..... 208/89; 208/58; 208/59; 208/97; 208/107; 208/108; 208/142

(58) Field of Classification Search ..... 208/58, 208/59, 89, 97, 107, 108, 142
See application file for complete search history.

(56) References Cited

U.S. PATENT DOCUMENTS 6,096,191 A 8/2000 Kalnes ..... 208/105
6,623,623 B2 * 9/2003 Kalnes ..... 208/89
6,638,418 B1 * 10/2003 Kalnes et al. ..... 208/89

* cited by examiner

*Primary Examiner*—Glenn Caldarola
*Assistant Examiner*—Prem C. Singh
(74) *Attorney, Agent, or Firm*—James C Paschall

(57) ABSTRACT

An integrated process for the upgrading of a vacuum gas oil feedstock and a light cycle oil feedstock. The vacuum gas oil feedstock is hydrodesulfurized and the light cycle oil feedstock is hydrocracked.

20 Claims, 1 Drawing Sheet

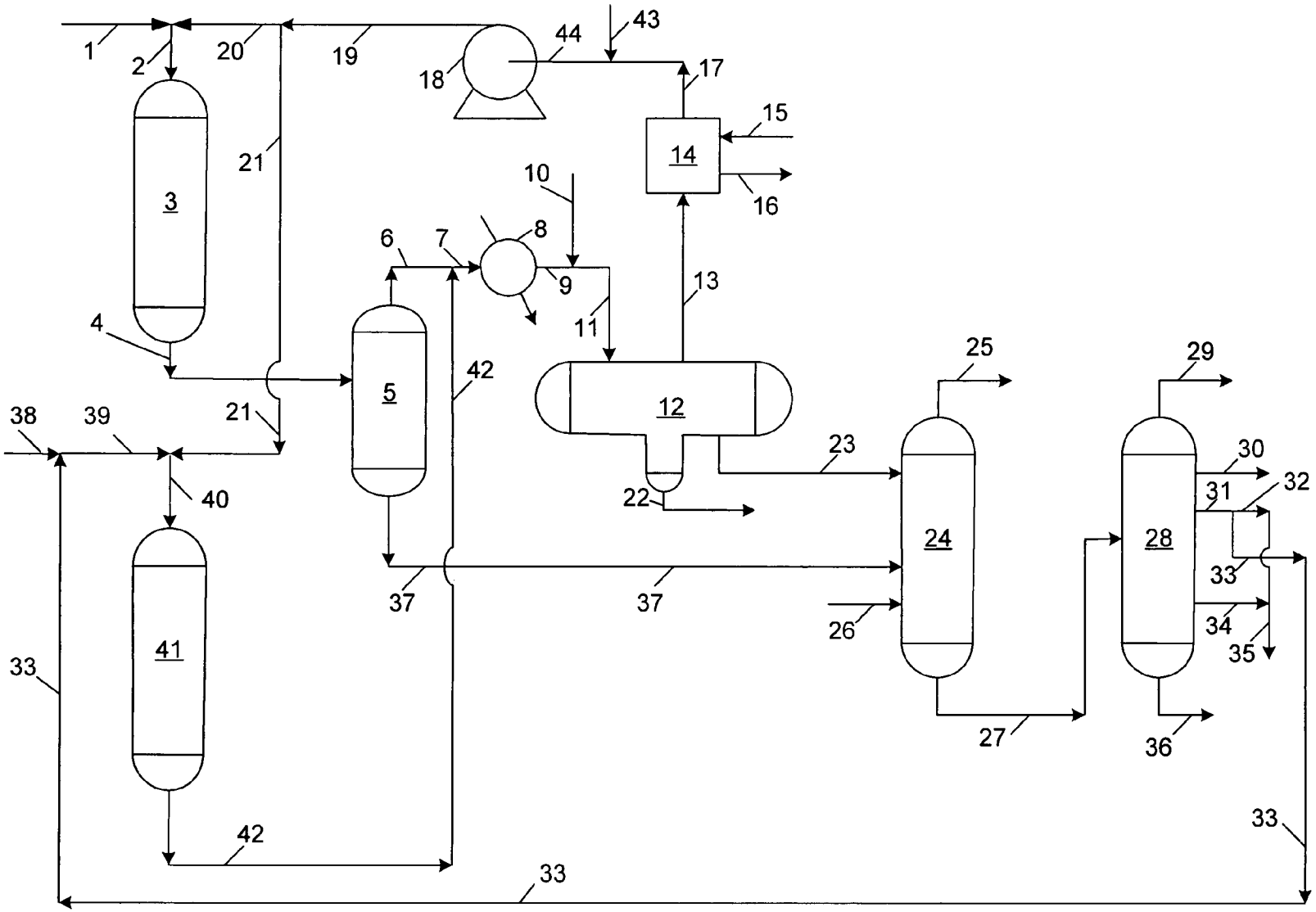
1
2
3
4
5
6
7
8
9
10
11
12
13
14
15
16
17
18
19
20
21
22
23
24
25
26
27
28
29
30
31
32
33
34
35
36
37
38
39
40
41
42
43
44

HYDROCARBON CONVERSION PROCESS

BACKGROUND OF THE INVENTION

The field of art to which this invention pertains is the hydrodesulfurization of a high boiling range hydrocarbonaceous feedstock such as vacuum gas oil and the hydrocracking of another hydrocarbonaceous feedstock comprising light cycle oil. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oil recovered from crude oil by distillation. A typical gas oil comprises a substantial portion of hydrocarbon components boiling above about 371° C. (700° F.), usually at least about 50 percent by weight boiling above 371° C. (700° F.). A typical vacuum gas oil normally has a boiling point range between about 315° C. (600° F.) and about 565° C. (1050° F.). A light cycle oil (LCO) is produced during the fluid catalytic cracking (FCC) of gas oil feedstocks to primarily produce gasoline boiling range hydrocarbons. Light cycle oil is an undesirable refractory by-product of the FCC process and therefore is a low value product. Previously, LCO was blended into the diesel pool or used as cutter stock for heavy fuel oil. These traditional outlets are being diminished or eliminated because of the demands of the marketplace. LCO generally boils in the range of about 149° C. (300° F.) to about 371° C. (700° F.).

Although a wide variety of process flow schemes, operating conditions and catalysts have been used in commercial hydrodesulfurization and hydrocracking activities, there is always a demand for new methods which provide more useful products from distressed feedstocks and to provide improved product characteristics. The present invention is able to economically hydrocrack a first feedstock containing LCO in an integrated process while simultaneously desulfurizing a second feedstock containing high boiling range hydrocarbons. The higher boiling components of the second feedstock with a reduced concentration of sulfur compounds are an ideal feedstock for a fluid catalytic cracking unit (FCC).

INFORMATION DISCLOSURE

U.S. Pat. No. 6,096,191 B1 discloses a catalytic hydrocracking process wherein a hydrocarbonaceous feedstock and a liquid recycle stream are contacted with hydrogen and a hydrocracking catalyst to obtain conversion to lower boiling hydrocarbons. The resulting effluent from the hydrocracking zone is hydrogen stripped at essentially the same pressure as the hydrocracking zone and at least a portion is recycled to the hydrocracking reaction zone.

BRIEF SUMMARY OF THE INVENTION

The present invention is an integrated process for the hydrodesulfurization of a hydrocarbonaceous feedstock comprising high boiling range hydrocarbons and the hydrocracking of a hydrocarbonaceous feedstock comprising light cycle oil. The feedstock comprising high boiling range hydrocarbons is reacted in a hydrodesulfurization reaction zone to produce a hydrocarbonaceous stream having a reduced concentration of sulfur. Another feedstock comprising LCO is reacted in a hydrocracking zone containing hydrocracking catalyst to produce an effluent stream comprising naphtha boiling range hydrocarbons. The effluent stream from the hydrodesulfurization reaction zone is preferably separated in a hot vapor liquid separator to provide a hydrocarbonaceous vapor stream comprising hydrogen, hydrogen sulfide and ammonia, and a liquid hydrocarbonaceous stream comprising hydrocarbons having a reduced concentration of sulfur which is separated, preferably in a fractionation zone, to provide a stream comprising diesel boiling range hydrocarbons. The feedstock comprising LCO together with a recycle stream comprising a portion of the diesel boiling range hydrocarbons in a hydrocracking zone containing hydrocracking catalyst to produce a hydrocarbonaceous stream comprising naphtha and diesel boiling range hydrocarbons which is separated to provide an ultra low sulfur diesel stream having superior cetane rating characteristics.

Other embodiments of the present invention encompass further details such as types and descriptions of feedstocks, hydrodesulfurization catalysts, hydrocracking catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The above described drawing is intended to be schematically illustrative of the present invention and is not intended to be a limitation thereof.

DETAILED DESCRIPTION OF THE INVENTION

An integrated hydrodesulfurization and hydrocracking process has been discovered which is capable of converting and desulfurizing a hydrocarbonaceous feedstock containing high boiling range hydrocarbons, such as vacuum gas oil for example, and hydrocracking a second hydrocarbonaceous feedstock containing light cycle oil.

The hydrocarbonaceous feedstock containing high boiling range hydrocarbons preferably boils in a range greater than LCO. A preferred feedstock for the hydrodesulfurization reaction is a vacuum gas oil which is recovered from crude oil by distillation and has a substantial portion of hydrocarbon components boiling above about 371° C. (700° F.), usually at least 50 percent by weight boiling above 371° C. (700° F.). A typical vacuum gas oil normally has a boiling range between about 315° C. (600° F.) and about 565° C. (1050° F.). The desulfurization of the feedstock also produces diesel boiling range hydrocarbons which contain enough sulfur to disqualify their use in a pool to produce ultra low sulfur diesel. These diesel boiling range hydrocarbons unfortunately also have poor or inferior cetane rating characteristics which must be improved for the production of high quality diesel fuel.

Another feedstock contains light cycle oil which is an undesirable by-product produced in an FCC unit while converting vacuum gas oil to gasoline. Light cycle oil is an economical and advantageous feedstock for the present invention since it is undesirable as a finished product and contains significant quantities of sulfur, nitrogen and polynuclear aromatic compounds. Therefore, the present invention is able to convert a feedstock containing low-value LCO and another feedstock containing vacuum gas oil into a valuable naphtha boiling range hydrocarbon stream and a desirable feed for a fluid catalytic cracking process.

In accordance with the present invention, the selected feedstock containing high boiling range hydrocarbons is introduced into a hydrodesulfurization reaction zone together with hydrogen at hydrodesulfurization conditions preferably including a temperature from about 204° C. (400° F.) to about 482° C. (900° F.), a pressure from about 3.5 MPa (500 psig) to about 17.3 MPa (2500 psig) and a liquid hourly space velocity from about 0.1 $hr^{-1}$ to about 10 $hr^{-1}$.

The term "hydrodesulfurization" as used herein refers to processes wherein a hydrogen-containing treat gas is used in the presence of suitable catalysts which are primarily active for the removal of heteroatoms, such as sulfur and nitrogen. Suitable hydrodesulfurization catalysts for use in the present invention are any known conventional hydrodesulfurization catalyst and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrodesulfurization catalysts include zeolitic catalysts, as well as noble metal catalysts where the noble metal is selected from palladium and platinum. It is within the scope of the present invention that more than one type of hydrotreating catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

The resulting effluent from the hydrodesulfurization zone is preferably introduced into a hot vapor liquid separator preferably operated at a temperature from about 149° C. (300° F.) to about 400° C. (752° F.) and a pressure from about 3.5 MPa (500 psig) to about 17.3 MPa (2500 psig) to provide a vaporous hydrocarbonaceous stream comprising hydrogen, hydrogen sulfide and ammonia and a liquid hydrocarbonaceous stream having a reduced concentration of sulfur. The hydrocarbonaceous stream having a reduced concentration of sulfur is separated in a separation zone such as a fractionator to provide diesel boiling range hydrocarbons. The primary purpose of the desulfurization reaction zone is to significantly reduce the sulfur level in the feedstock containing high boiling range hydrocarbons which preferably may be further processed in an FCC unit. Since the severity of desulfurization in the reaction zone is not able to achieve the essentially complete desulfurization of the diesel boiling range hydrocarbons which are produced along with the desulfurization of the original feedstock, at least a portion of the diesel boiling range hydrocarbons produced in the desulfurization reaction zone are recycled and included with the feedstock to the hydrocracking reaction zone.

The vaporous hydrocarbonaceous stream comprising hydrogen, hydrogen sulfide and ammonia is cooled, partially condensed and introduced into a cold vapor liquid separator. Further details of the operation of the cold vapor liquid separator and subsequent separation and disposition are described hereinafter. The hydrocarbonaceous stream having a reduced concentration of sulfur is separated in a separation zone such as a fractionator to provide diesel boiling range hydrocarbons. In accordance with the present invention, the diesel boiling range hydrocarbons are preferably separated to provide a light diesel stream boiling in the range from about 149° C. (300° F.) to about 315° C. (600° F.) and a heavy diesel stream boiling in the range from about 232° C. (450° F.) to about 382° C. (720° F.).

In accordance with the present invention, a feedstock comprising LCO together with a recycle stream comprising a portion of the diesel boiling range hydrocarbons recovered from the effluent of the hydrodesulfurization reaction zone is introduced into a hydrocracking zone. The hydrocracking zone may contain one or more beds of the same or different catalyst. In one embodiment the preferred hydrocracking catalysts utilize amorphous bases or low-level zeolite bases combined with one or more Group VIII or Group VIB metal hydrogenation components. In another embodiment, the hydrocracking zone contains a catalyst which comprises, in general, any crystalline zeolite cracking base upon which is deposited a minor proportion of a Group VIII metal hydrogenating component. Additional hydrogenation components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms. It is preferred to employ zeolites having a silica/alumina mole ratio between about 3 and 12. Suitable zeolites found in nature include, for example, mordenite, stillbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms, wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenation metal or metals, the resulting catalyst powder is then filtered, dried, pelleted with added lubricants, binders or the like, if desired, and calcined in air at temperatures of e.g., 371°-648° C. (700°-1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking reaction zone is conducted in the presence of hydrogen and preferably at hydrocracking reaction zone conditions which include a temperature from about 232° C. (450° F.) to about 468° C. (875° F.), a pressure from about 3.5 MPa (500 psig) to about 17.3 MPa (2500 psig), a liquid hourly space velocity (LHSV) from about 0.1 to about 30 $hr^{-1}$, and a hydrogen circulation rate from about 337 normal $m^3/m^3$ (2000 standard cubic feet per barrel) to about 4200 $m^3/m^3$ (25000 standard cubic feet per barrel). In accordance with the present invention, the hydrocracking conditions are selected on the basis of the vaporous hydrocarbon stream with the objective of the production of naphtha boiling range hydrocarbons and desulfurized diesel boiling range hydrocarbons.

The resulting effluent from the hydrocracking zone is cooled, partially condensed and introduced into the previously mentioned cold vapor liquid separator preferably operated at a temperature from about 16° C. (60° F.) to about 71° C. (160° F.) and a pressure from about 3.5 MPa (500 psig) to about 17.3 MPa (2500 psig). A hydrogen-rich gaseous stream is removed from the cold vapor liquid separator and preferably scrubbed with an absorbent to remove hydrogen sulfide. A resulting hydrogen rich gaseous stream having a reduced hydrogen sulfide concentration is compressed and recycled to the hydrodesulfurization zone and the hydrocracking zone. Make-up hydrogen may be introduced into the process at any convenient location to maintain the desired pressure and provide a reactant to the hydrodesulfurization and hydrocracking reaction zones.

A liquid hydrocarbonaceous stream is removed from the cold vapor liquid separator and is separated, preferably by fractionation, to produce normally gaseous hydrocarbons, naphtha boiling range hydrocarbons and middle distillate boiling range hydrocarbons including diesel boiling range hydrocarbons. The hydrocracking reaction zone is preferably operated to yield naphtha boiling range hydrocarbons and desulfurized diesel boiling range hydrocarbons.

Various heat exchangers may be utilized in the effluent streams from the hydrodesulfurization reaction zone and the hydrocracking zone to achieve the process of the present invention. Such heat exchange will be obtained by one skilled in the art without undue experimentation.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feedstock containing vacuum gas oil is introduced into the process via line 1 and is admixed with a hydrogen-rich recycle gas provided via line 20 and the resulting admixture is transported via line 2 and introduced into hydrodesulfurization reaction zone 3. The resulting effluent from hydrodesulfurization reaction zone 3 is carried via line 4 and introduced into hot vapor liquid separator 5. A vaporous hydrocarbonaceous stream is removed from hot vapor liquid separator 5 via line 6 and is joined by a hereinafter described stream provided via line 42 and the resulting admixture is transported via line 7 and introduced into heat exchanger 8. A resulting cooled and partially condensed hydrocarbonaceous stream is removed from heat exchanger 8 via line 9 and is admixed with an aqueous stream provided via line 10. The resulting admixture is carried via line 11 and introduced into cold vapor liquid separator 12. A hydrogen-rich gaseous stream is removed from cold vapor liquid separator 12 via line 13 and introduced into absorption 14 and contacted with a lean absorption solution, preferably an amine solution, provided via line 15 to remove hydrogen sulfide. A rich absorption liquid is removed from absorption zone 14 via line 16 and recovered. A hydrogen-rich gaseous stream having a reduced concentration of hydrogen sulfide is removed from absorption zone 14 via line 17 and is admixed with a hydrogen makeup stream provided via line 43 and the resulting mixture is carried via line 44 and introduced into compressor 18. A compressed hydrogen-rich gaseous stream is removed from compressor 18 via line 19 and a first portion is carried via line 19 and introduced into hydrodesulfurization zone 3 via lines 20 and 2. An aqueous stream containing nitrogen compounds is removed from cold vapor liquid separator 12 via line 22 and recovered. The liquid hydrocarbonaceous stream is removed from cold vapor liquid separator 12 via line 23 and introduced into stripper 24. Steam is introduced via line 26 into stripper 24 to remove hydrogen and normally gaseous hydrocarbons from stripper 24 via line 25. A liquid hydrocarbonaceous stream from hot vapor liquid separator 5 is carried via line 37 and introduced into stripper 24. A liquid hydrocarbonaceous stream is removed from stripper 24 via line 27 and introduced into fractionation zone 28. A naphtha stream carried via line 29 and a kerosene stream carried via line 30 is removed from fractionation zone 28 and recovered. A feedstock containing light cycle oil is introduced into the process via line 38 and is admixed with a hereinafter described light diesel stream carried via line 33 and the resulting mixture is transported via lines 39 and 40 and introduced into hydrocracking zone 41. A hydrocarbonaceous effluent is removed from hydrocracking zone 41 via line 42 and is admixed with a stream carried via line 6 as hereinabove described. A hydrogen-rich gaseous stream is transported via lines 19, 21 and 40 and introduced into hydrocracking zone 41. A light diesel stream is removed from fractionation zone 28 via line 31 and a portion is carried via line 33 and introduced into hydrocracking zone 41 as described hereinabove. Another portion of the light diesel is carried via lines 32 and 35 and recovered. A heavy diesel stream is removed from fractionation zone 28 via lines 34 and 35 and recovered. A heavy distillate hydrocarbon stream is removed from fractionation zone 28 via line 36 and recovered.

The foregoing description of the drawing clearly illustrate the advantages encompassed by the process of the present invention and the benefits to be afforded with the use thereof.

What is claimed is:

1. An integrated process for the upgrading of a vacuum gas oil feedstock and a light cycle oil feedstock which process comprises:

(a) reacting a hydrocarbonaceous feedstock comprising vacuum gas oil in a hydrodesulfurization reaction zone to produce a hydrocarbonaceous stream having a reduced concentration of sulfur;

(b) reacting a hydrocarbonaceous feedstock comprising light cycle oil in a hydrocracking reaction zone to produce a hydrocarbonaceous stream comprising diesel boiling range hydrocarbons;

(c) separating the hydrocarbonaceous stream having a reduced concentration of sulfur from step (a) and the hydrocarbonaceous stream comprising diesel boiling range hydrocarbons from step (b) in a separation zone to provide a light diesel stream and a hydrocarbonaceous stream having a reduced concentration of sulfur;

(d) recycling at least a portion of the light diesel stream to the hydrocracking reaction zone in step (b); and (e) recovering a hydrocarbonaceous steam comprising diesel.

2. The process of claim 1 wherein the hydrodesulfurization reaction zone is operated at a temperature from about 204° C. (400° F.) to about 482° C. (900° F.), a pressure from about 3.5 MPa (500 psig) to about 17.3 MPa (2500 psig) and a liquid hourly space velocity from about 0.1 $hr^{-1}$ to about 10 $hr^{-1}$.

3. The process of claim 1 wherein the hydrocracking reaction zone is operated at a temperature from about 232° C. (450° F.) to about 468° C. (875° F.) and a pressure from about 3.5 MPa (500 psig) to about 17.3 MPa (2500 psig).

4. The process of claim 1 wherein the light cycle oil feedstock boils in the range from about 149° C. (300° F.) to about 371° C. (700° F.).

5. The process of claim 1 wherein the vacuum gas oil feedstock boils in the range from about 315° C. (600° F.) to about 565° C. (1050° F.).

6. The process of claim 1 wherein the light diesel stream boils in the range from about 149° C. (300° F.) to about 315° C. (600° F.).

7. The process of claim 1 wherein the separation zone comprises a fractionation zone.

8. An integrated process for the upgrading of a vacuum gas oil feedstock and a light cycle oil feedstock which process comprises:

(a) reacting a hydrocarbonaceous feedstock comprising vacuum gas oil in a hydrodesulfurization reaction zone to produce a hydrocarbonaceous stream having a reduced concentration of sulfur;

(b) reacting a hydrocarbonaceous feedstock comprising light cycle oil in a hydrocracking reaction zone to produce a hydrocarbonaceous stream comprising diesel boiling range hydrocarbons;

(c) separating the hydrocarbonaceous stream having a reduced concentration of sulfur from step (a) and the hydrocarbonaceous stream comprising diesel boiling range hydrocarbons from step (b) in a separation zone to provide a light diesel stream, a heavy diesel stream and a hydrocarbonaceous stream having a reduced concentration of sulfur and boiling in the range of the vacuum gas oil feedstock;

(d) recycling at least a portion of the light diesel stream to the hydrocracking reaction zone in step (b); and (e) recovering a hydrocarbonaceous steam comprising diesel.

9. The process of claim 8 wherein the hydrodesulfurization reaction zone is operated at a temperature from about 204° C. (400° F.) to about 482° C. (900° F.), a pressure from about 3.5 MPa (500 psig) to about 17.3 MPa (2500 psig) and a liquid hourly space velocity from about 0.1 $hr^{-1}$ to about 10 $hr^{-1}$.

10. The process of claim 8 wherein the hydrocracking reaction zone is operated at a temperature from about 232° C. (450° F.) to about 468° C. (875° F.) and a pressure from about 3.5 MPa (500 psig) to about 17.3 MPa (2500 psig).

11. The process of claim 8 wherein the light cycle oil feedstock boils in the range from about 149° C. (300° F.) to about 371° C. (700° F.).

12. The process of claim 8 wherein the vacuum gas oil feedstock boils in the range from about 315° C. (600° F.) to about 565° C. (1050° F.).

13. The process of claim 8 wherein the light diesel stream boils in the range from about 149° C. (300° F.) to about 315° C. (600° F.).

14. The process of claim 8 wherein the heavy diesel stream boils in the range from about 232° C. (450° F.) to about 382° C. (720° F.).

15. The process of claim 8 wherein the separation zone comprises a fractionation zone.

16. An integrated process for the upgrading of a vacuum gas oil feedstock and a light cycle oil feedstock which process comprises:

(a) reacting a hydrocarbonaceous feedstock comprising vacuum gas oil in a hydrodesulfurization reaction zone operated at conditions including a temperature from about 204° C. (400° F.) to about 482° C. (900° F.), a pressure from about 3.5 MPa (500 psig) to about 17.3 MPa (2500 psig) and a liquid hourly space velocity from about 0.1 $hr^{-1}$ to about 10 $hr^{-1}$ to produce a hydrocarbonaceous stream having a reduced concentration of sulfur;

(b) reacting a hydrocarbonaceous feedstock comprising light cycle oil in a hydrocracking reaction zone operated at conditions including a temperature from about 232° C. (450° F.) to about 468 C (875° F.) and a pressure from about 3.5 MPa (500 psig) to about 17.3 MPa (2500 psig) to produce a hydrocarbonaceous stream comprising diesel boiling range hydrocarbons;

(c) fractionating the hydrocarbonaceous stream having a reduced concentration of sulfur from step (a) and the hydrocarbonaceous stream comprising diesel boiling range hydrocarbons from step (b) in a fractionation zone to provide a light diesel stream, a heavy diesel stream and a hydrocarbonaceous stream having a reduced concentration of sulfur and boiling in the range of the vacuum gas oil feedstock;

(d) recycling at least a portion of the light diesel stream to the hydrocracking reaction zone in step (b); and (e) recovering a hydrocarbonaceous stream comprising diesel.

17. The process of claim 16 wherein the light cycle oil feedstock boils in the range from about 149° C. (300° F.) to about 371° C. (700° F.).

18. The process of claim 16 wherein the vacuum gas oil feedstock boils in the range from about 315° C. (600° F.) to about 565° C. (1050° F.).

19. The process of claim 16 wherein the light diesel stream boils in the range from about 149° C. (300° F.) to about 315° C. (600° F.).

20. The process of claim 16 wherein the separation zone comprises a fractionation zone.

* * * * *